United States Patent [19]

Dykes

[11] 4,183,154

[45] Jan. 15, 1980

[54] INSTRUCTIONAL CHAIR

[76] Inventor: Earl R. Dykes, Rte. 4, Box 74, Lake City, Fla. 32055

[21] Appl. No.: 927,896

[22] Filed: Jul. 25, 1978

[51] Int. Cl.[2] ..... A63H 33/04

[52] U.S. Cl. ..... 35/73; 46/17; 297/440

[58] Field of Search ..... 35/29 R, 60, 73; 46/17; 297/118, 440, 442, 463

[56] References Cited

U.S. PATENT DOCUMENTS

| | | | |
|---|---|---|---|
| 2,677,914 | 5/1954 | Christie | 46/17 |
| 2,765,580 | 10/1956 | Herrschaft | 46/17 X |
| 3,137,967 | 6/1964 | Flieth | 35/73 X |
| 3,611,618 | 10/1971 | Steiner | 46/17 |
| 4,077,517 | 3/1978 | Hilemn | 297/440 X |
| 4,079,995 | 3/1978 | Beckley | 297/440 |
| 4,082,356 | 4/1978 | Johnson | 297/442 |

*Primary Examiner*—Harland S. Skogquist
*Attorney, Agent, or Firm*—George H. Baldwin; Arthur G. Yeager

[57] ABSTRACT

A bolted together disassemblable instructional chair having color coded and number coded or letter coded joint portions and with joining portions provided with respectively different numbers and sizes of bolt openings fitted with corresponding bolts and nuts.

10 Claims, 3 Drawing Figures

INSTRUCTIONAL CHAIR

SUMMARY OF THE INVENTION

This invention relates to an article of furniture, preferably a chair, comprised of a number of pieces, such as the posts and rails of a chair, which are bolted together. The parts of the members which fit and bolt together to form the article are visually coded such as by numerals or letters and colors or the like, to teach a child to recognize and to put together similarly coded pieces. The end portions of a rail may bolt to joint portions of two upright posts, and these meeting portions are drilled to receive numbers and sizes of bolts which differ as between one joint and another, so that each rail must be properly oriented and must be bolted to the correct corresponding joint portions of two posts.

OBJECTS OF THE INVENTION

A general object is to provide a furniture article which may be assembled and disassembled by a child for instructional purposes.

A more particular object is to provide a useful article of furniture which may be assembled and disassembled by a child, of, for example, a mental age of about three to nine years, which excites a desire in the child to complete the assembly and which provides, when the task of assembly is completed, a rewarding sense of accomplishment in having put together a useful article.

A further object of the invention is to provide means to educate a child in various skills and to develop orderliness, and specifically to teach a child to distinguish and to relate colors, numbers, letters or other visual indicia, sizes and patterns of openings and of the corresponding bolts to fit such openings, in the relationship of proper nuts for such bolts, and in relating the proper respective sizes and types of tools for use in manipulating such bolts and nuts, as well as providing practice leading to manual dexterity, eye-hand coordination and in developing ability to plan an assembly task and to solve construction problems, all in such a way as to minimize the chance of causing frustration of the child.

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawing, in which:

Figure 2:
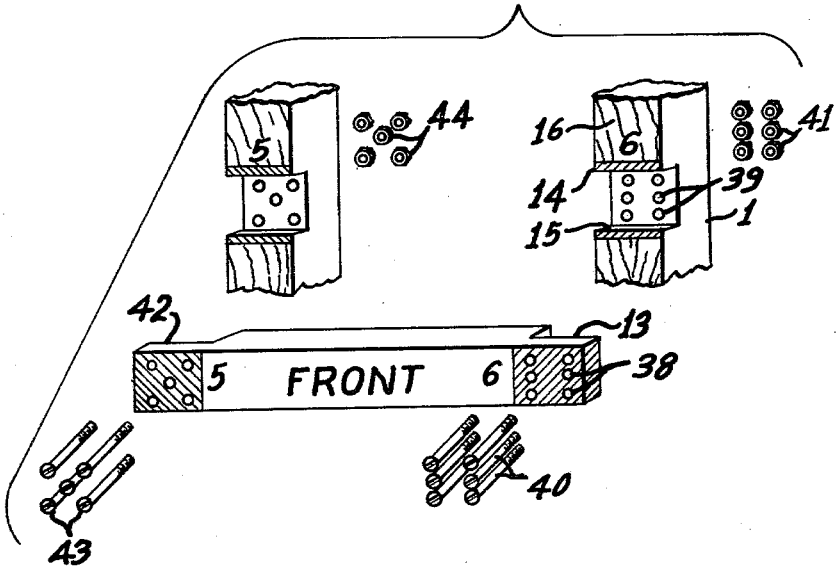
FIG. 2 is an exploded view on an enlarged scale of certain portions of the chair.

A wooden chair embodying the invention is shown in the drawings and comprises upright front posts or legs 1 and 2, upright rear posts 3 and 4 a horizontal front rail 5, two horizontal side rails 6 and 7, two horizontal side rails 8 and 9, which also serve as stringers, a horizontal lower back rail 10 and two horizontal upper back rails 11 and 12, such posts, rails and stringers serving as the primary structural elements with rails 11 and 12 further serving as back rest slats. Each end of each of the aforesaid horizontal rails and stringers is rabbeted or notched across the end portion to form a rectilinear tongue end joint portions, such as tongue 13 of rail 5 seen in FIG. 2.

A complementary rectangular face mortise to receive each such tongue is cut into a joint portion of one of the posts. Joint portion 14 of post 1 is thus provided with face mortise 15 interrupting the front face 16 of the post and proportioned fittingly to receive tongue 13 to form a lap butt joint 17. A similar lap butt joint 18 is provided between the other end portion of rail 5 and post 2. The end portions of side rails 6 and 7 are joined at similar joints 48, 19, 20 and 21 to the front and back posts 1, 3, 2 and 4, respectively, as are the stringers 8 and 9, by lap butt joints 22, 23, 24 and 25. The lower back rail 10 is provided with tongues, such as tongue 26, which are let into mortises in the rear faces of the posts 3 and 4, such as rear face 27 of post 3, forming lap butt joint 28 with post 3 and lap butt joint 29 with post 4. The upper back rails 11 and 12 have tongues fitting mortise openings in the forward faces of the posts 3 and 4, such as tongue 30 of rail 12 fitting in a mortise cut into post 3 through the front face 31 thereof to form lap butt joint 32. Rail or slat 12 joins back post 4 in a similar lap butt joint 33 and rail 11 joins posts 3 and 4 in lap butt joints 34 and 35, respectively.

Figure 1:
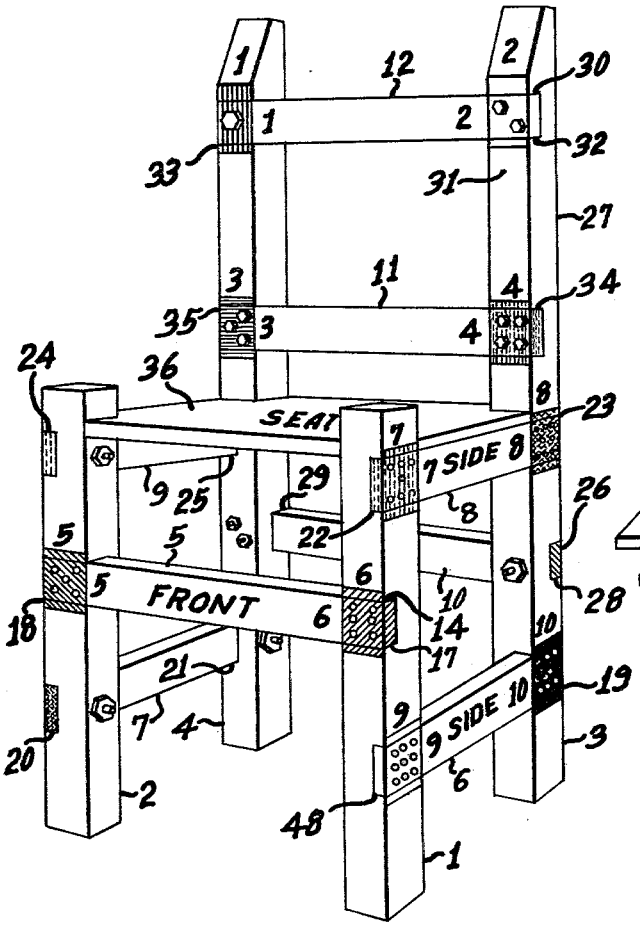
FIG. 1 is a perspective view of a disassemblable chair in accord with my invention.
Figure 3:
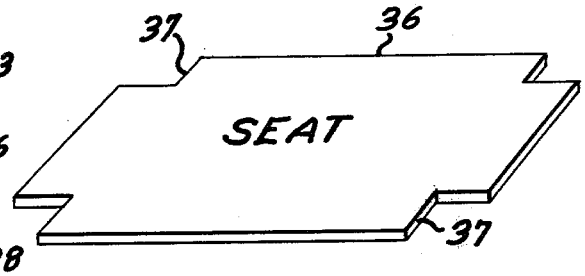
FIG. 3 is a perspective view on a further enlarged scale of a seat element of the chair.

A flat wooden seat member 36 seen in FIG. 3 is provided with relieved corner portions as shown at 37 to receive one of the four posts at each corner. The seat member rests for support on stringers 8 and 9. The seat member is preferably not fixedly attached to the chair frame but is freely liftable therefrom.

Each tongue of each rail and stringer is provided with one or more bolt openings and the respective joint portion of each post is provided with respectively aligned bolt openings of the same size and arranged in the same pattern. Thus joint 17, between front rail 5 and joint portion 14 of post 1, is formed by fitting tongue 13 into conforming face mortise 15 with each of the six bolt openings 38 which extend through the tongue aligned with a corresponding one of the six bolt openings 39 which extend through the joint portion of the post opening into the mortise 15. The openings are seen to be in a pattern of parallel vertical rows of three bolt openings. The joint is stabilized or fixed by passing each of six metal bolts 40 through a respective one of the openings 38 and the respective aligned one of the openings 38 and, finally, by screwing one of the six metal hex nuts 41 on the projecting end of each bolt.

The bolts 40 for joint 17 are slotted or screw head one-quarter inch diameter bolts having lengths one-quarter or one-half inch greater than the combined lengths of one of the openings 38 and the corresponding one of the openings 39 to provide a convenient length beyond rail 1 to receive the respective nut 41. The openings 38 and 39 are proportioned fittingly to receive the bolts 40, being greater than one-quarter inch in diameter by a small clearance distance, such that the bolts may be readily pushed through the openings by small fingers without requiring substantial force.

The front face 16 at the joint portion 14 of post 1 adjacent the mortise 15 and the exposed surface of tongue 13 are colored brown by being painted in that color.

At the opposite end of rail 5 tongue 42 and the post 2 adjacent joint 18 are similarly painted in the color green, and the tongue and post at this joint are each provided with five bolt openings to receive respective ones of five one-quarter inch slotted or screw headed bolts 43, the joint being stabilized and fixed when, as with joint 17, the nuts 44 are threaded onto these bolts behind post 2.

Other joints are differently color coded and fixed with different respective numbers of bolts. Joint 18 between front post 1 and side rail 6, for example, may be painted white and may be fixed with nine three-sixteenths inch diameter bolts arranged in three parallel vertical columns of three, while joint 19 between rail 6 and rear post 3 may be color coded black and may be fixed with ten three-sixteenths inch diameter bolts arranged in two horizontal rows of three and one horizontal row of four bolts. Similarly, the joints 22 and 23 at opposite ends of stringer 8 are color coded violet and orange, respectively, and are, respectively, fixed by seven and eight three-sixteenths inch diameter slotted screw head bolts.

Joints 32 and 33 are color coded in white and red, respectively, and are, respectively, fixed by two five-sixteenths inch diameter hex head bolts and by one-half inch diameter hex head bolt, while joints 34 and 35 are color coded in yellow and blue, respectively, and are, respectively, fixed by four five-sixteenths inch diameter hex head bolts and by three five-sixteenths inch diameter hex head bolts.

Joint 28 may be color coded in a darker or lighter green than joint 18 and may be fixed by one three-quarter inch diameter hex head bolt, and joint 29 may be color coded in another selected color, such as light gray, and fixed by two five-sixteenth inch hex head bolts, preferrably arranged in a pattern opposite to that of joint 32 so that rail member 12 cannot be substituted for rail 10. Joint 24 is shown as color coded purple and is fixed by one five-sixteenth inch diameter hex head bolt, while joint 25 may be color coded dark gray and may be fixed by two one-half inch diameter hex head bolts (not shown). Joint 20, color coded dark orange, and joint 21, having a further color code, e.g. pink, are respectively fixed by one seven-eighths inch and one three-quarter inch hex head bolt.

The meeting members at each joint are further coded by numerals painted thereon adjacent the joint, and the numerals preferably where possible, correspond to the number of bolts for the respective joints. Such numerals include the digits "1" through "9", and, in the chair as disclosed, also include the two digit numeral "10". Thus rail 12 and post 4 each carry the numeral "1" painted thereon adjacent joint 33, which is fixed by one bolt, and this rail and post 3 each carry the numeral "2" painted thereon adjacent joint 32, which is fixed by two bolts. Similarly rail 5 and post 2 are marked with the numeral "5" adjacent joint 18, fixed with five bolts, and such rail and post 1 are marked with the numeral 6 adjacent joint 17, fixed with six bolts. This sequence is continued up to the joint 19 where the meeting elements are marked with the numeral "10" and ten bolts are used to stabilize or complete the joint.

Joints 20, 21, 24, and 28 are seen to be completed by single bolts, which may be a seven-eighths inch hex head bolt, a three-quarter inch hex head bolt, a five-sixteenths inch hex head bolt, and another three-quarter inch hex head bolt, respectively, each provided with an appropriate nut. Joints 25 and 29 may each be fixed by two five-sixteenths inch hex head bolts and nuts.

It is contemplated that the meeting elements at the joints 20, 21, 24, 25, 26 and 29 should be marked with matching letters in the same manner in which the above described meeting elements at joints such as joints 17, 18, 22, 23, and 18, are marked with matching numerals.

The chair may be sold as a disassembled kit or in assembled condition and, in either case, is adapted for repeated assembly and disassembly.

The manner in which assembly is accomplished is by placing a tongue into a matching mortise, following the number coding or letter coding and the color coding, by selecting the proper number and size of bolts and nuts, by passing the bolt shank or shanks through the tongue openings and through the respective aligned openings in the respective upright, and by then applying a nut to each bolt. The child is taught to select colors that match, numbers that match and number and sizes of bolt holes that match as between the two elements joined at each joint. The joints need not be assembled in any specific order, but the child will soon learn that assembly of one complete section of the chair, for example, of the back posts with rails 10, 11 and 12, progressing then to connection of first one and then the other side to the assembled back is a more orderly method than to join one end of one rail or stringer to one upright post, then an end of another rail to another post, and an end of yet another rail or stringer to a third post, thus to have two or three or four disconnected subassemblies which must thereafter be connected together. Alternatively, the child may decide to separate the bolts into groups of like sizes, and then to complete all joints for each size of bolts before moving on to the next bolt size. As a further alternative, the child may elect to match all number coded members and to complete the joints 32, 33, 34, 35, 22, 23, 48, 19, 17 and 18 of which the elements to be joined are numerically coded, then to proceed with letter coded joints 20, 21, 24, 25, 28 and 29. Accordingly, the invention provides several orderly procedures for assembling the chair.

Various parts of the chair may additionally be labeled, for example, the rail and stringer 6 and 8 may be labeled "SIDE", rail 5 may be labeled "FRONT" and set member 36 may be labeled "SEAT" as indicated in the drawing, to teach younger children to recognize such words.

It is deemed important that the completed structure is a useful object which can be used by its assembler for a practical purpose.

Each time that the chair is disassembled and reassembled, the child is given the opportunity to increase his or her skills, dexterity, planning abilities and abilities to recognize and appreciate color, numeral, letter and size relationships.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A bolted together disassemblable and reassemblable instructional furniture article comprising a plurality of upright post members and a plurality of generally horizontal rail members, each said rail having end lap joint portions meeting corresponding predetermined respective joint portions of said post members and forming respective lap joints therewith, at least some of said joint portions of said posts being provided with respectively visually distinguishable coding indicia and the ones of said end portions of said rail members which respectively meet said joint portions of said posts being provided with respectively matching visually distinguishable coding indicia, the respective rail end lap joint portion and the post joint portion at each joint being provided with aligned bolt openings, bolts fittingly received in said openings for stabilizing said joints, at least several of said joints differing from each other in the numbers and sizes of said openings and bolts.

2. The combination according to claim 1 wherein at least several of said joints have respective pluralities of said openings arranged in respective patterns and differing each from each other in the number and patterns of such openings.

3. The combination according to claim 1 or 2 wherein said visually distinguishable coding indicia comprise representations of readable characters.

4. The combination according to claim 3 wherein said characters are numerical.

5. The combination according to claim 1 wherein said indicia of some of said joint portions and the respective meeting end portions are digital indicia and the respective corresponding joints are provided with a number of bolt openings corresponding to said digital indicia.

6. The combination according to claim 1 wherein said joints are lap butt joints.

7. The combination according to claim 1 wherein one of said joints is stabilized with a first predetermined number of hex head bolts each of a first predetermined size, wherein another of said joints is stabilized with a second different predetermined number of hex head bolts of a second different predetermined size, and wherein a further one of said joints is stabilized with a third different predetermined number of bolts having slotted heads each of a predetermined size differing from said first and second predetermined sizes.

8. The combination according to claim 7 wherein said indicia carried by the joint portions adjacent each of said one, said other and said further joint correspond to said first, said second and said third predetermined numbers of bolts respectively.

9. In a bolted together disassemblable and reassemblable instructional chair comprising four upright posts and at least five rails, each said rail being connected between a pair of said posts and having opposite end lap portions connected by respective lap joints to respective joints portions of the posts of such pair, thereby to form ten such lap joints, characterized in that each such lap portion and the respective said joint portion is provided with a respectively equal number of aligned bolt-receiving through-bores of from one to ten, and in that each said lap portion and the respective joint portion carries thereon a readable numeral from 1 to 10 conforming to the number of through-bores therethrough.

10. A bolted together disassemblable and reassemblable instructional chair comprising a plurality of upright post members and a plurality of generally horizontal rail members, each said rail having end lap butt joint portions meeting corresponding predetermined respective joint portions of said post members and forming respective lap butt joints therewith, at least some of said joint portions of said posts being provided with respectively different color coding indicia and the ones of said end portions of said rail members which respectively meet said joint portions of said posts being provided with respectively matching color coding indicia, the respective rail end lap joint portion and the post joint portion at each joint being provided with aligned bolt openings, bolts fittingly received in said openings for stabilizing said joints.

* * * * *